US008398339B2

(12) United States Patent
Riha

(10) Patent No.: US 8,398,339 B2
(45) Date of Patent: Mar. 19, 2013

(54) SELF-TENSIONING TENDON FOR TENSION LEG PLATFORM APPLICATION

(75) Inventor: Jesse B. Riha, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 537 days.

(21) Appl. No.: 12/552,196

(22) Filed: Sep. 1, 2009

(65) Prior Publication Data

US 2010/0232886 A1 Sep. 16, 2010

Related U.S. Application Data

(60) Provisional application No. 61/106,024, filed on Oct. 16, 2008.

(51) Int. Cl.
*E02B 17/00* (2006.01)

(52) U.S. Cl. ..... 405/223.1; 405/224; 405/224.1; 114/265

(58) Field of Classification Search ..... 405/195.1, 405/196, 223.1, 224, 224.1; 441/3–5; 114/265, 114/230.12

See application file for complete search history.

(56) References Cited

U.S. PATENT DOCUMENTS 4,881,852 A * 11/1989 Gunderson ..... 405/224
5,899,638 A 5/1999 Pallini, Jr.
7,044,685 B2 * 5/2006 Wybro et al. ..... 405/207

* cited by examiner

*Primary Examiner* — Sean Andrish
(74) *Attorney, Agent, or Firm* — Bracewell & Giuliani LLP

(57) ABSTRACT

A self-tensioning tendon for pulling a tension leg platform (TLP) down to a desired draft position. The self-tensioning tendon can be utilized with either a co-installation process or a pre-installation process and connects to an assembled tendon joint. The self-tensioning tendon comprises a hydraulically controlled Length Adjustment Joint (LAJ) that further comprises an integral cylinder with external threads and a piston rod. The self-tensioning apparatus has features that advantageously reduce the time required to ballast the hull of the TLP. A hydraulic source actuates the integral cylinder to pull the TLP down to the target draft position, significantly reducing the time needed to ballast the hull of the TLP with millions of gallons of water. A Top Tendon Connector (TTC) ratchets down along the cylinder to lock the TLP at the final draft position.

9 Claims, 4 Drawing Sheets

SELF-TENSIONING TENDON FOR TENSION LEG PLATFORM APPLICATION

CROSS-REFERENCE TO RELATED APPLICATION

This application claims priority to provisional application 61/106,024, filed Oct. 16, 2008.

FIELD OF THE INVENTION

This invention relates in general to tension leg platforms (TLPs) used in offshore oil production, and in particular, to reducing the time and expense associated with achieving the required draft level of the platform via the use of self-tensioning tendons that reduce ballasting time.

BACKGROUND OF THE INVENTION

A tension leg platform (TLP) is a vertically moored floating structure typically used for the offshore production of oil or gas. The platform is permanently moored by means of tethers or tendons connected to the structure of the TLP. A group of tethers is called a tension leg.

Generally the installation process of a TLP is lengthy and extremely expensive. In general, there are two different methods to install a TLP, referred to as pre-installation and co-installation. Conventionally, the pre-installation method initiates by locking the mooring systems, called tendons, into the existing foundation piles. The tendons are held in stable tension using a temporary air can or buoyancy module. The platform is ballasted down onto the tendons and locked into place at the proper draft, then deballasted to the proper tendon tension. The buoyancy cans are then removed, resulting in a stable structure.

The other conventional method of installing a TLP is called co-installation. This method involves assembling the mooring system, also referred to as tendons, prior to TLP installation. All the tendons are hung from the platform and centered over the existing foundation piles. The platform is ballasted down to lock the tendons into to the foundation piles. The platform is then de-ballasted to the proper draft and tendon tension.

The operation of installing a TLP, whether pre-installation or co-installation, is very time consuming and costly. This is especially true for the process of ballasting and de-ballasting the hull. Hull ballasting requires the movement of millions of gallons of seawater. This process typically takes up to 24 to 48 hours to complete. A need exists for a technique to reduce ballasting time while reducing unnecessary and costly installation equipment for both types of TLP installation methods.

SUMMARY OF THE INVENTION

In an embodiment of the present technique, a self-tensioning apparatus for installing a tension leg platform (TLP) is provided that can connect to a tendon string. Thus the self-tensioning apparatus could be utilized during the installation of a TLP with each of a plurality of tendon strings. The self-tensioning apparatus has features that advantageously reduce the time required to ballast the hull of the TLP. The self-tensioning apparatus can have a Length Adjustment Joint (LAJ) comprising an integral cylinder with external threads along its length, and a piston rod with a piston that can stroke nearly the length of the cylinder in response to pressurization of the cylinder during installation of the TLP. The bottom of the cylinder can connect to a tendon string and a soft line can connect to the top of the piston rod. The soft line can be, for example, an adjustable chain or steel cable attached to a clevis located at the top end of the piston rod.

In the illustrated embodiments, the self-tensioning apparatus can be utilized in either the pre-installation or co-installation procedures for installing a TLP. In the co-installation process, an entire tendon string is assembled out of sections of steel pipe and placed in the water in proximity to the TLP. A Bottom Tendon Connector (BTC) is provided at the bottom end of the tendon string. A Top Tendon Connector (TTC) is also provided and engages the external threads of the cylinder. The entire tendon string assembly can then be hung onto a hull porch with the TTC.

Hydraulic lines can be run from a hydraulic source down to the top and bottom ends of the LAJ's integral cylinder to provide pressurization of the cylinder and thereby stroke the piston rod in or out. The soft line can be anchored to the TLP and pulled tight as required.

In the illustrated embodiments of the co-installation process, the TTC is disengaged from the threaded integral cylinder and the soft line is pulled tight by the weight of the tendon string. The hydraulic line feeding the hydraulic fluid into the bottom of the LAJ, causes the integral cylinder 18 to extend until the bottom portion of the tendon string is locked into an existing foundation pile via a BTC. The TTC can again engage the threaded integral cylinder, and the top of the LAJ is pressurized to retract the integral cylinder. The retraction of the LAJ's integral cylinder pulls the TLP down to the target draft position without the need of costly and time-consuming ballasting. The target draft position is maintained by the TTC, which ratchets down the length of the threaded integral cylinder and prevents the cylinder from moving down with respect to the TTC. The target tendon tension can then be achieved by minimal de-ballasting of the hull using seawater and the soft line can be removed. Further, the hydraulic lines and the piston rod can be removed from the integral cylinder.

Pre-installation is an alternate method similar to the co-installation process described above. As described in the co-installation method above, the entire tendon string is similarly assembled and placed in the water in proximity to the TLP. As in the co-installation method, the tendon string is made up of sections of steel pipe and includes a BTC at the bottom end of the tendon string. The tendon string also includes an LAJ comprising an integral cylinder and a piston rod that can stroke nearly the length of the cylinder. The integral cylinder is controlled by hydraulic power and has external threads along its length. Unlike the co-installation process, the tendon string is first locked to the existing foundation pile via the BTC and air cans or buoyancy modules are used to keep the tendon string buoyant and under stable tension.

Further unlike the co-installation process where the TTC is part of the tendon string, in the pre-installation process the TTC is installed at the hull porch on the TLP. The TTC on the porch can be aligned approximately above the buoyed tendon string. An adjustable soft line is first attached at an anchor point on the TLP and lowered down through the TTC and secured to the end of the piston rod. This is further unlike the co-installation process where the soft line is first attached to the piston rod and then to the anchor point on the TLP.

In the illustrated embodiments of the pre-installation process, the hydraulic lines are also lowered through the TTC on the hull porch and connected to the top and bottom ends of the LAJ's integral cylinder. The hydraulic line feeding the hydraulic fluid into the top of the LAJ, causes the integral cylinder 18 to partially retract until the top of the cylinder is approximately up through the TTC on the hull porch. The tightened soft line creates a reaction point at the anchor point to allow the TLP to be pulled down.

The TTC engages the threaded integral cylinder and the top hydraulic line feeds hydraulic fluid into the top of the LAJ's integral cylinder, causing the integral cylinder to retract and causing the TLP to move down until the target draft position is reached. The TTC ratchets down the length of the threaded cylinder as the cylinder retracts and prevents the cylinder from moving down with respect to the TTC. As in the co-installation process, the target tendon tension is achieved by minimal de-ballasting of the hull using seawater. At this point the TLP is at the final draft position and the soft line can be removed. Further, the hydraulic lines and the piston rod can be removed from the cylinder.

The TTC along with the LAJ comprising the integral cylinder and the piston rod, allow the TLP to be pulled down to a target draft position in a timely and cost effective manner due to the significant decrease in hull ballasting requirements.

DETAILED DESCRIPTION OF THE INVENTION

Figures 1A, 1B, 1C, 1D, 1E:
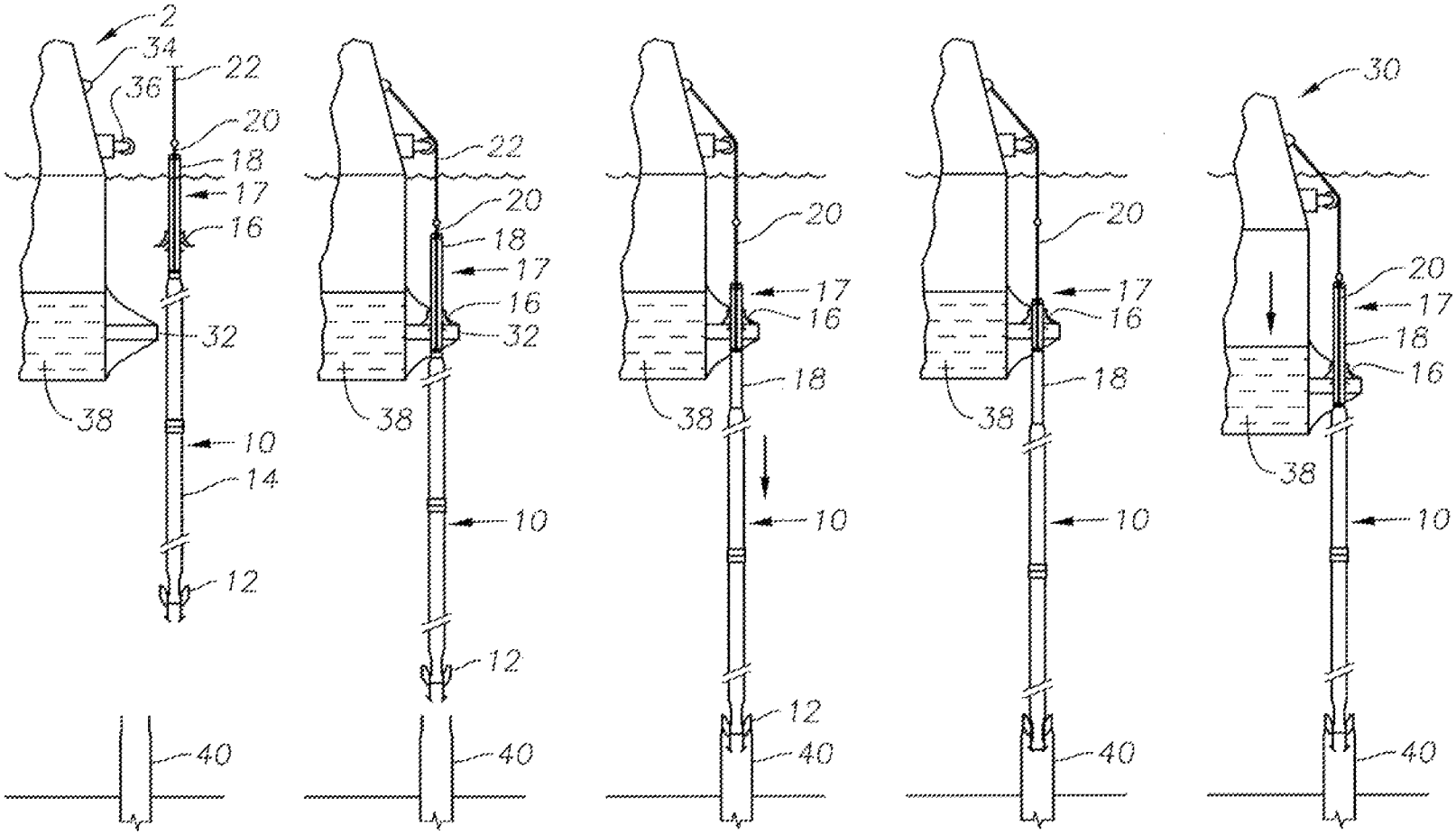
FIGS. 1A through 1E, are illustrations of a TLP co-installation process, in accordance with an exemplary embodiment of the present technique.
Figure 3A:
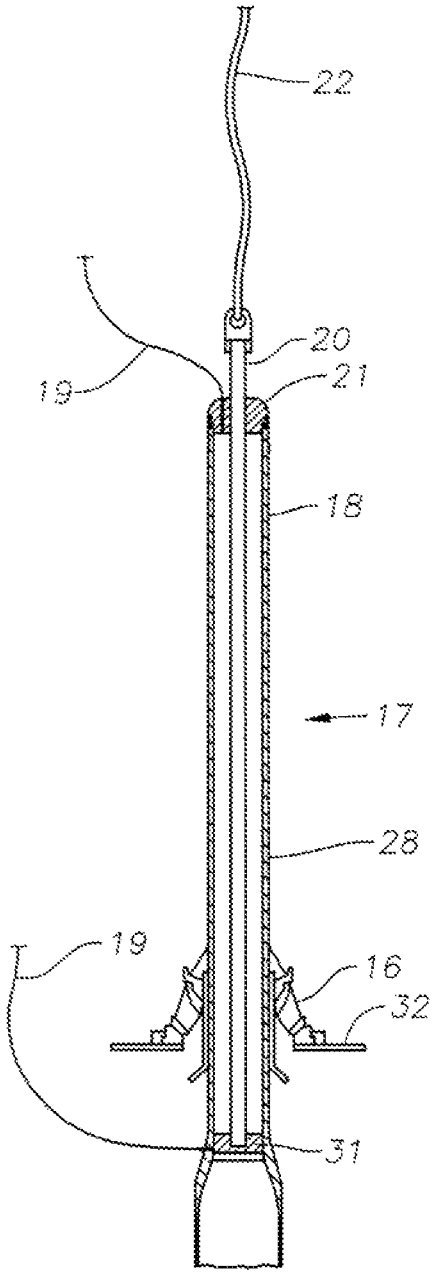
FIG. 3A is an illustration showing the LAJ with cylinder in the retracted position, in accordance with an exemplary embodiment of the present technique.

Referring to FIGS. 1A through 1E, the co-installation process of a Tension Leg Platform (TLP) 2 is illustrated. Entire tendon string 10 is assembled and placed in the water in proximity to the TLP 2. The tendon string 10 is made up of sections of steel pipe 14 connected to each other at their ends and includes a Bottom Tendon Connector (BTC) 12 at the bottom end of the tendon string 10. The tendon string 10 also includes a Top Tendon Connector (TTC) 16 and a Length Adjustment Joint (LAJ) 17. The LAJ is made up of an integral cylinder 18 and a piston rod 20 that can move axially within the cylinder 18 and can stroke nearly the length of the cylinder 18. For example, an LAJ 17 design may accommodate in excess of 30 feet of stroke and 1,250 kips of pulling force. The integral cylinder is controlled by a hydraulic power unit (not shown) installed on the platform. Referring to FIG. 3A, cylinder 18 has external threads 28 or grooves along its length. The TTC 16 is engaged to the external threads 28 on the cylinder 18. A soft line 22 is attached to the end of the piston rod 20. As illustrated in FIG. 1A, the integral cylinder is initially set to the retracted position (FIG. 3A). BTC 12 is located a short distance above foundation pile 40. The distance is less than the length of LAJ 17 with the cylinder 18 in the retracted position.

As illustrated in FIG. 1B, the tendon string 10 assembly is hung onto the hull porch 32 with the TTC 16 connected to the porch 32. The porch 32 has a c-shaped side opening that allows the tendon string 10 to enter the porch 32 from the side. Hydraulic lines 19 (FIG. 3A) are connected from a supply (not shown) on the TLP 2 to the end cap 21 (FIG. 3A) at the top of the integral cylinder 18, and also connected to the bottom end of the cylinder 18. The soft line 22 at the end of the piston rod 20 is anchored to the TLP 2 hull at an anchor point 34 and guided onto a pulley 36. The soft line 22 preferably has some slack at this stage. The soft line 22 could be an adjustable chain or cable.

Figure 4:
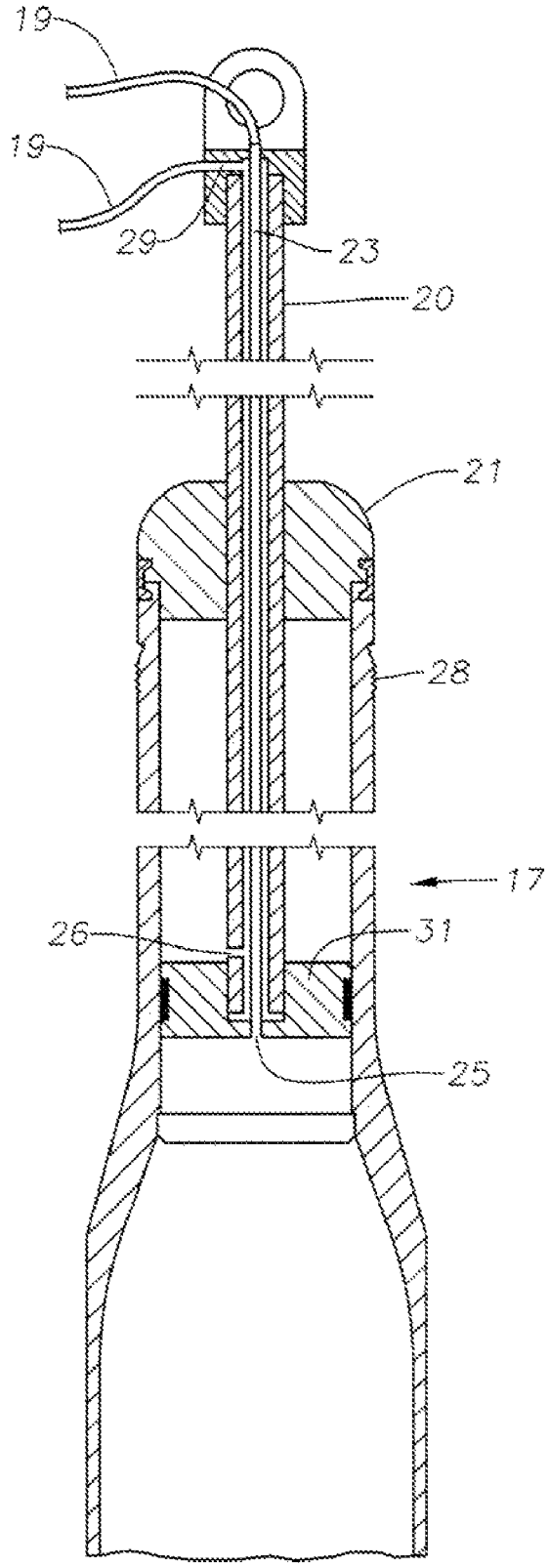
FIG. 4 is a sectional view illustrating a portion of an alternate embodiment of the LAJ.

Alternatively, as illustrated in FIG. 4, the piston rod 20 could be hollow and the hydraulic line 19 could be connected to the top of the piston rod 20, with rod 20 having a communication port 23 extending just above the piston rod 20. The communication port 23 runs down the hollow portion of piston rod 20 and through the piston 31 via a port 25. The ports 23, 25 feed hydraulic fluid to the cylinder 18 chamber under the piston for rod 20 stroke out. Further, hydraulic line 19 could be connected to a port 29 on the side of the upper part of piston rod 20 to feed hydraulic fluid through the hollow part of piston rod 20. A port 26 on the side of the lower part of piston rod 20 and just above the piston communicates hydraulic fluid from the hollow rod 20 to the cylinder 18 chamber above the piston for rod 20 stroke in.

Figure 3B:
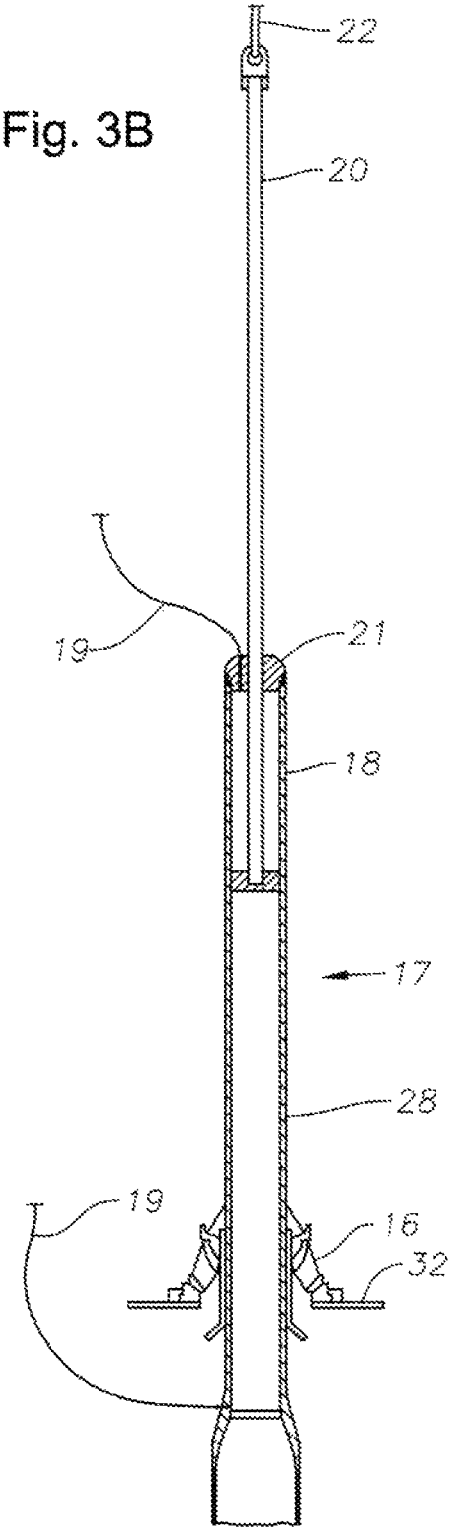
FIG. 3B is an illustration showing the LAJ with cylinder in the extended position, in accordance with an exemplary embodiment of the present technique.

As illustrated in FIG. 1C, the TTC 16 is disengaged from the threaded integral cylinder 18 and the soft line 22 is pulled tight by the weight of the tendon string 10. The bottom hydraulic line 19 (FIG. 3B) feeds hydraulic fluid into the bottom of the LAJ 17, causing the integral cylinder 18 to extend (FIG. 3B). The cylinder 18 is extended until the tendon 10 is locked into the existing foundation pile 40 via a BTC 12 as illustrated in FIG. 1D.

The TTC 16 again engages the threaded integral cylinder 18, and the top hydraulic line 19 (FIG. 3A) feeds hydraulic fluid into the top of the LAJ 17, causing the integral cylinder 18 to retract. As the cylinder 18 is retracted (FIG. 3A), it exerts a force on the TLP 2 that pulls TLP 2 down to the target draft position as illustrated in FIG. 1E. This target draft position is achieved without ballasting. In addition, the TTC 16 ratchets down the length of the threaded cylinder 18 as the cylinder 18 retracts and prevents the cylinder 18 from moving down with respect to the TTC 16. Target tendon tension is achieved by minimal de-ballasting of the hull using seawater 38. At this point the TLP 2 is at the final draft position and the soft line 22 can be removed. Further, the hydraulic lines 19 and the piston rod 20 can be removed from the cylinder. Piston rod 20 may alternatively be stroked in and left in place.

Figures 2A, 2B, 2C, 2D, 2E:
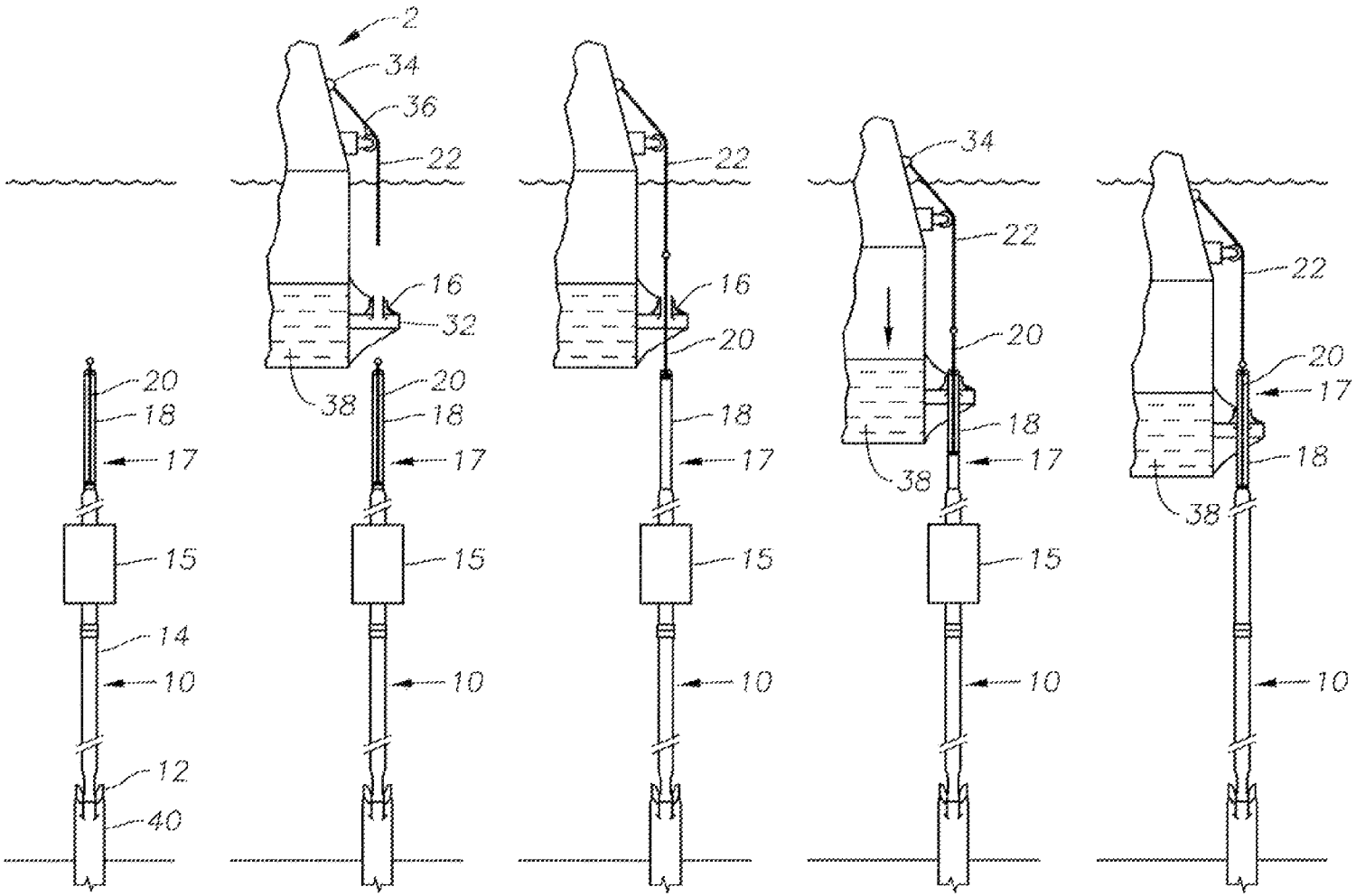
FIGS. 2A through 2E are illustrations of a TLP pre-installation process, in accordance with an exemplary embodiment of the present technique.

Pre-installation is an alternate method to the co-installation process of FIGS. 1A to 1E. Referring to FIGS. 2A through 2E, the pre-installation process of a TLP 2 is illustrated. As described in the co-installation method above, the entire tendon string 10 is similarly assembled and placed in the water in proximity to the TLP 2. The tendon string 10 is made up of sections of steel pipe 14 connected to each other at their ends and includes a BTC 12 at the bottom end of the tendon string 10. The tendon string 10 also includes an LAJ 17. The LAJ is made up of an integral cylinder 18 and a piston rod 20 that can move axially within the cylinder 18 and can stroke nearly the length of the cylinder 18. For example, an LAJ 17 design may accommodate in excess of 30 feet of stroke and 1,250 kips of pulling force. The integral cylinder is controlled by a hydraulic power unit (not shown) installed on the platform. Cylinder 18 has external threads or grooves along its length. Unlike the co-installation process, the pre-installation process uses air cans or buoyancy modules 15 to keep the tendon string 10 buoyant and under stable tension once the tendon 10 is locked into the existing foundation pile 40 via a BTC 12 as illustrated in FIG. 2A.

As illustrated in FIG. 2B, a TTC 16 is installed at the porch 32. This is unlike the co-installation process where the TTC 16 is part of the tendon string 10. The TLP 2 is located in the water such that the porch 32 and TTC 16 are approximately above the buoyed tendon string 10. A soft line 22 is attached at an anchor point 34 on the TLP 2 and guided onto a pulley 36. The soft line 22 could be an adjustable chain or cable.

As illustrated in FIG. 2C, the soft line 22 is lowered through the TTC 16 on the porch 32 and secured to the end of the piston rod 20. The TTC 16 is preferably in the disengaged position at this stage and the soft line 22 has some slack. Hydraulic lines 19 (FIG. 3A) connected to a supply (not shown) on the TLP 2, are also lowered through the TTC 16 on the porch 32 and are connected to the end cap 21 (FIG. 3A) at the top of the integral cylinder 18, or end of piston rod 20 as previously described, and connected to the bottom end of the cylinder 18.

As illustrated in FIGS. 2C and 2D, the top hydraulic line 19 (FIG. 3A) feeds hydraulic fluid into the top of the LAJ 17, causing the integral cylinder 18 to partially retract. The cylinder 18 is extended until the top of the cylinder is approximately up through the TTC 16. At the point illustrated by FIG. 2D, the soft line 22 is pulled tight. The soft line 22 can also be connected to the anchor point 34 at this stage rather than earlier in the process as described in the previous section.

The TTC 16 engages the threaded integral cylinder 18 and the top hydraulic line 19 (FIG. 3A) feeds hydraulic fluid into the top of the LAJ 17, causing the integral cylinder 18 to retract. As the cylinder 18 is retracted (FIG. 3A), the TLP 2 begins to be pulled down (FIG. 2D) until the target draft position is reached as illustrated in FIG. 2E. In addition, the TTC 16 ratchets down the length of the threaded cylinder 18 as the cylinder 18 retracts and prevents the cylinder 18 from moving down with respect to the TTC 16. Target tendon tension is achieved by minimal de-ballasting of the hull using seawater 38. At this point the TLP 2 is at the final draft position and the soft line 22 can be removed. Further, the hydraulic lines 19 and the piston rod 20 can be removed from the cylinder.

In this embodiment, the hydraulic supply is located on the platform. However, the hydraulic supply may be located elsewhere, such as on the porch 32. Alternatively, the hydraulic supply could be located on a structure independent from the TLP 2.

In an additional embodiment (not shown), a motor moves the internal cylinder 18 up or down through the TTC 16 to achieve the desired draft position for the TLP 2. In another alternative embodiment (not shown), the internal cylinder 18 moves up or down through the TTC 16 via a screw-like drive to achieve the desired draft position for the TLP 2. A plurality of tendon strings 10 will utilize the self-tensioning apparatus and undergo the installation methods described above to bring the TLP 2 to the desired draft position.

In yet another embodiment, either of the hydraulic cylinder 18 or the piston rod 20 can be adapted to be coupled to a tendon 10 that is coupled to the subsea structure. Further, one of the hydraulic cylinder 18 or the piston rod 20 is coupleable to the TLP 2 to enable the hydraulic cylinder 18 assembly to draw the TLP 2 toward the subsea structure by retracting the piston 20 into the hydraulic cylinder 18.

An LAJ 17 design may accommodate in excess of 30 feet of stroke and 1,250 kips of pulling force. The integral cylinder is controlled by a hydraulic power unit (not shown) installed on the platform. The cylinder pulls the TLP down to the desired draft position with minimal ballasting and achieves desired tension and draft tuning with minimal de-ballasting. The system eliminates the need to ballast the TLP down onto the tendons in the pre-installation process or to lock the tendons onto the foundation piles in the co-installation process. Thus the system reduces the time and expense associated with traditional ballasting and deballasting by drastically reducing the amount of seawater that must be pumped in and out of the hull.

Other advantages of the system is that platform stability is ensured by not exceeding the minimum and maximum draft limits of the platform, and allows for the use of a stroke indicator to make fine adjustments during installation. The cylinder can also be used in conjunction with the active ratcheting feature of the TTC to perform flawlessly during platform heave. Further, the components are integrated to reduce additional installation equipment and the steps of the method can simply be reversed to easily decommission the platform. Finally the cost of an auxiliary cylinder barrel is not required.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for installing a Tension Leg Platform ("TLP"), comprising:

attaching an extension sub to an upper end of a tendon, defining a tendon assembly, and a fixed line between the extension sub and the TLP, the extension sub comprising a cylinder with a grooved external profile and a piston rod at an upper end of the cylinder;

attaching a lower end of the tendon assembly to a piling;

extending the line through a top connector on the TLP so that the top connector circumscribes a portion of the cylinder;

retracting a length of the extension sub, thereby pulling the TLP downward;

wherein the top connector is engaged to the external profile of the cylinder after the tendon is stabbingly engaged to the piling, the cylinder axially moving relative to the top connector to a retracted position in response to increased hydraulic pressure in an upper chamber of the cylinder to thereby exert a force on the tension leg platform through the line that pulls the tension leg platform down until a target draft position is reached without ballasting of a hull; and wherein the top connector ratchets down a length of the exterior profile of the cylinder to lock the target draft position of the tension leg platform.

2. The method of claim 1, wherein the exterior profile of the cylinder is threaded.

3. The method of claim 1, wherein the line is pulled tight to create a reaction point as the cylinder moves upward.

4. A method for installing a Tension Leg Platform comprising:

attaching an extension sub to an upper end of a tendon, defining a tendon assembly, and a fixed line between the extension sub and the TLP, the extension sub comprising a cylinder with a grooved external profile and a piston rod at an upper end of the cylinder;

attaching a lower end of the tension assembly to a piling;

extending the line through a top connector on the TLP and circumscribing a portion of the cylinder with the top connector;

retracting a length of the extension sub, thereby pulling the TLP downward;

wherein attaching the lower end of the tendon assembly comprises lowering the tendon assembly util a bottom connector on the tendon assembly stabbingly engages to the piling, and prior to retracting the length of the extension sub, the tendon assembly is maintained under stable tension by a buoyancy module connected to the tendon assembly; and wherein while retracting the length of the extension sub, the cylinder axially moves upward relative to the top connector in response to increased hydraulic pressure in an upper chamber of the cylinder defined by a space above the piston within the cylinder, the cylinder retracting as the cylinder moves upward, the top connector engaging a grooved profile along an exterior of the cylinder when the upper end of the cylinder is received by an opening in the top connector.

5. The method of claim 4, wherein the top connector ratchets down a length of a grooved profile of the cylinder while the cylinder moves upward relative to the top connector to lock the target draft position of the tension leg platform.

6. An apparatus for installing a Tension Leg Platform ("TLP") having a hull comprising:

a tendon having a lower end adapted to be secured to a piling;

a hydraulic cylinder defining an upper end of the tendon and having an external grooved profile;

a piston rod having a piston that slidingly engages the cylinder during operation;

a ratcheting top connector adapted to be mounted to the platform, the ratcheting top connector engaging the external grooved profile of the cylinder;

a soft line having a lower end connected to a top of the piston rod and an upper end adapted to be secured to the TLP; and a hydraulic pressure line connected to the cylinder, the cylinder when supplied with hydraulic fluid pressure moving upward relative to the top connector to apply tension to the soft line and pull the TLP downward, causing the top connector to ratchet on the grooved profile of the cylinder to prevent the cylinder from moving downward relative to the top connector when the hydraulic fluid pressure is removed.

7. The assembly according to claim 6, wherein the cylinder is hermetically sealed to avoid the entry of sea water into the cylinder.

8. The assembly according to claim 6, wherein the piston rod is removeable from the cylinder after the hydraulic fluid pressure is removed.

9. The assembly according to claim 6, wherein the grooved profile on the cylinder comprises a set of threads.

* * * * *